United States Patent [19]

Foletta

[11] Patent Number: 4,624,017

[45] Date of Patent: Nov. 25, 1986

[54] AUTOMATIC FLUSHING SYSTEM

[76] Inventor: John D. Foletta, 38 Maple St., Holloway Beach, Queensland, 4871, Australia

[21] Appl. No.: 743,689

[22] Filed: Jun. 11, 1985

[51] Int. Cl.[4] ..... E03D 13/00

[52] U.S. Cl. ..... 4/304; 4/305; 4/313; 4/623; 4/DIG. 3

[58] Field of Search ..... 4/304, 305, DIG. 3, 4/623, 313

[56] References Cited

U.S. PATENT DOCUMENTS

| | | | |
|---|---|---|---|
| 3,434,164 | 3/1969 | Forbes | 4/304 |
| 3,471,868 | 10/1969 | Zorn | 4/304 |
| 3,523,305 | 8/1970 | Zorn | 4/304 |
| 3,863,196 | 1/1975 | Hilles | 4/304 X |
| 4,134,163 | 1/1979 | Matsunaga | 4/304 |
| 4,141,091 | 2/1979 | Pulvari | 4/DIG. 3 |
| 4,309,781 | 1/1982 | Lissau | 4/305 |

*Primary Examiner*—Henry K. Artis
*Attorney, Agent, or Firm*—Kenyon & Kenyon

[57] ABSTRACT

A flushing system for controlling the flushing operation of a urinal having one or more remotely controllable valves arranged in a flow path of fluid to the urinal, one or more sensors for detecting the presence of a user and controlling means including a timer for receiving the output from the sensor to actuate the valve(s) for a predetermined period of time and then turn the valve off to terminate the supply of fluid to the urinal.

11 Claims, 6 Drawing Figures

AUTOMATIC FLUSHING SYSTEM

Figure 1:
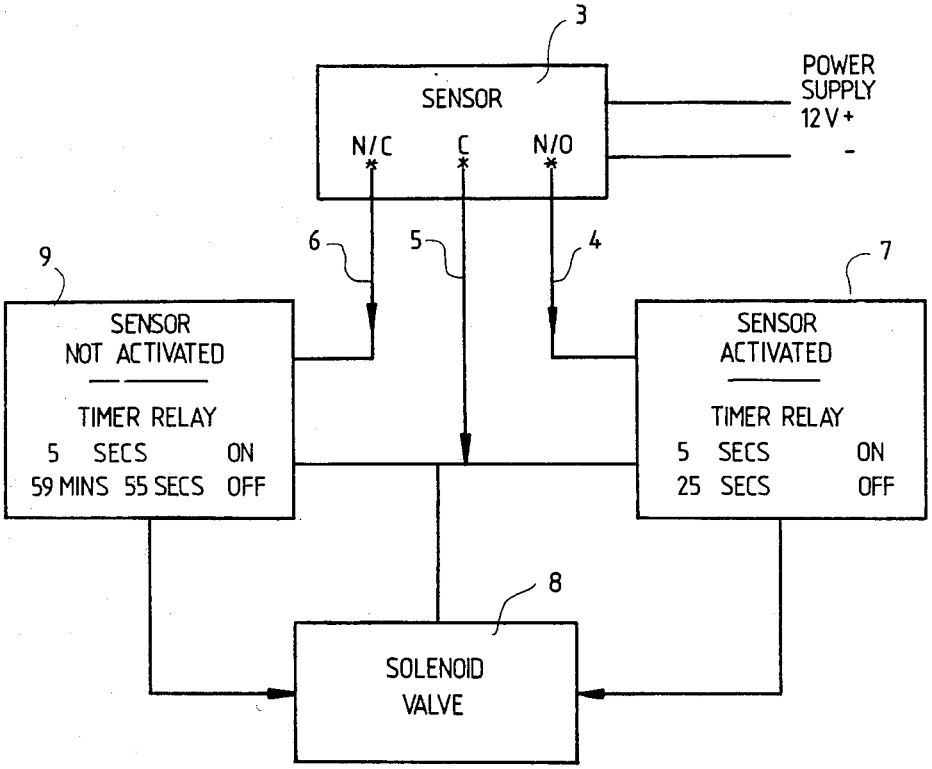

The present invention relates to an automatic flushing system. In particular, the invention concerns an automatic flushing system for a urinal.

Conventional urinal flushing systems include a header tank coupled to a supply of flushing liquid such as water. The tank includes level control means such as a float operated valve and a flushing actuator which enables the water in the tank to be selectively released through an outlet coupled to the tank; the outlet being coupled to feed water into a flusher pipe for release against the wall of the urinal. The flushing actuator is usually a release button on or associated with the tank. Alternatively the flushing actuator comprises a manually operable valve associated with the outlet. Such systems rely on the user of the urinal to initiate a flushing action after use of the urinal. If the user does not do this, then an unhygenic urinal may result.

In other known systems the urinal is automatically continuously flushed and thus the flushing operation no longer remains the responsibility of the user. However, with such systems large volumes of water are used that this is undesirable.

It is an object of the present invention to provide an automatic flushing system which alleviates the disadvantages of the known systems mentioned above.

The system of the invention will be described in relation to a flushing system having a tank or collector, an inlet, an outlet and an overflow. It should be appreciated that the system may also be advantageously used with other types of flushing systems.

The invention provides an automatic flushing system for controlling the flushing operation of urinal, the system comprising:

a remotely controllable valve arranged in a flow path of an inlet to the urinal;

a sensor for detecting the presence of an intending user of the system; and first valve controlling means including a timer, said controlling means receiving an output from the sensor to thereby turn the valve on to thereby flush the urinal for a predetermined period of time in response to the output and then turn the valve off.

The remotely controllable valve may be arranged in the flow path of the inlet. The valve is operable to prevent and enable flushing liquid to flow from the tank or collector and onto the urinal wall. The valve is preferably such that in its normal position the flow of liquid is inhibited and may be controlled to move to a flow position enabling liquid to flow through the outlet and onto the urinal wall. The valve may comprise any suitable valve controllable in this way. A preferred valve may be a diaphragm valve, although valves such as flap valves, rotary valves, plunger valves and the like may also be employed.

The system includes a first valve controller for controlling the operation of the valve. The first valve controller preferably functions to switch the valve to its on position for a predetermined time period and then off again. The first controller functions in this way to provide an off period of longer duration than the on period. For example, the first controller may provide for the valve to be turned on for 5 seconds every half minute. The first controller is adapted to receive a control signal from a sensor and functions to control the valve only in response to this signal. Preferably this controller cannot be actuated a subsequent time until at least 20 or 25 seconds have elapsed since the last on period or unless heavy traffic is present. This may be achieved by including an interlock timer with the controller.

The first controller may comprise any suitable device for controlling the action of the valve. For example, first controller may be a bi-metallic strip, heat sensitive means or the like. Ideally the first controller comprises a solenoid energizable to control the switching of the valve. To enable the periodic ON/OFF switching mentioned above to be achieved, the solenoid may include a suitable timer. In a preferred form, the first controller includes a timer relay for controlling the function of the solenoid.

The system of the invention may include a second valve controller. The comments made above in relation to the first controller apply equally to the second controller except that the controller preferably operates automatically to operate the valve. The second controller switches the valve on for a predetermined time period and then switches the valve off for a predetermined period of time. Preferably the second controller ensures that the valve is actuated for at least 5 seconds every hour following the sensor detecting the presence of an intending user.

The system of the invention may provide for an override control which enables flushing to be initiated manually independent of the operation provided by the first and second controllers. Thus the override control may be operative to directly control the function of the valve. Where the valve is a controlled valve such as a solenoid valve, the override control may simply be manually operated to control the solenoid valve. Where two solenoids are present, one or other of them may be caused to function by the manual override control.

Alternatively, the system, instead of having override control in the form mentioned above, may simply include a hand operated valve in the outlet to enable manual flushing to be achieved.

Figure 2A:
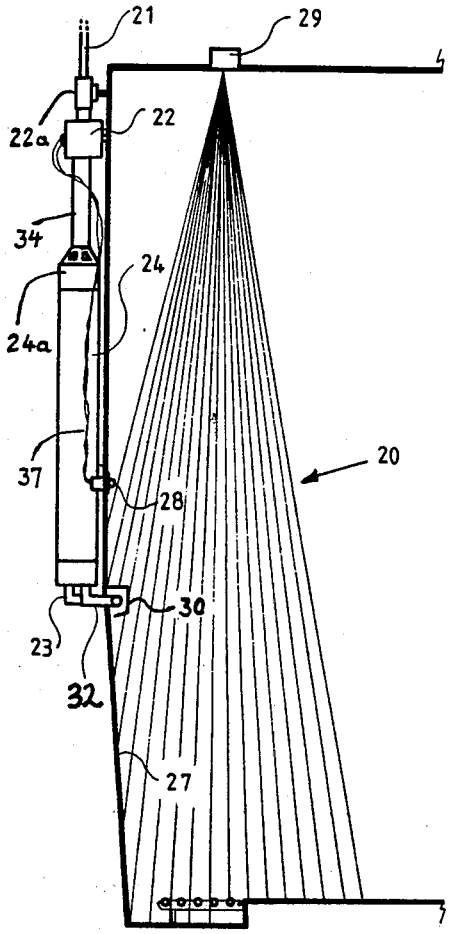
Figure 2B:
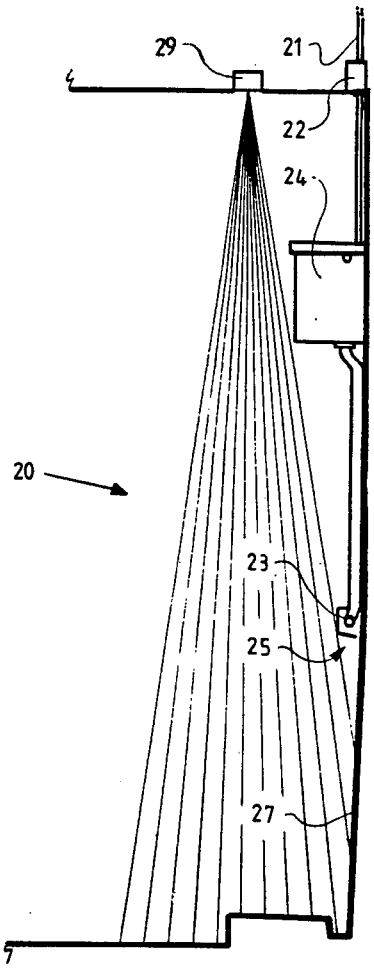
Figure 2C:
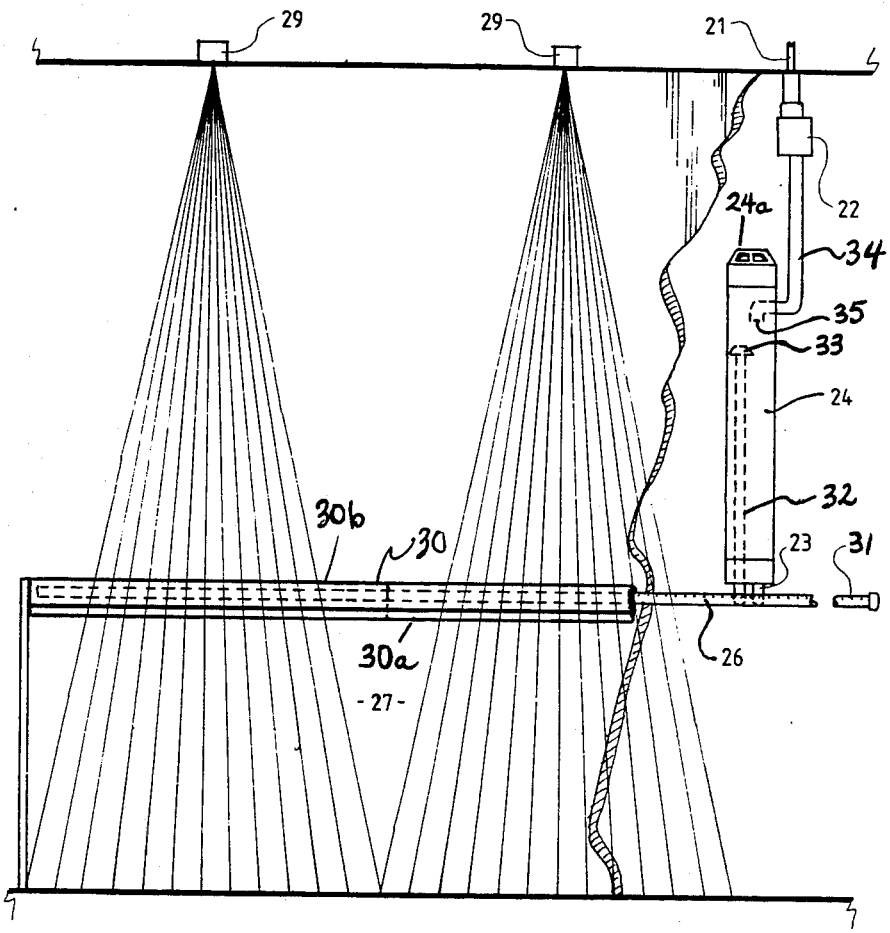
Figure 3A:
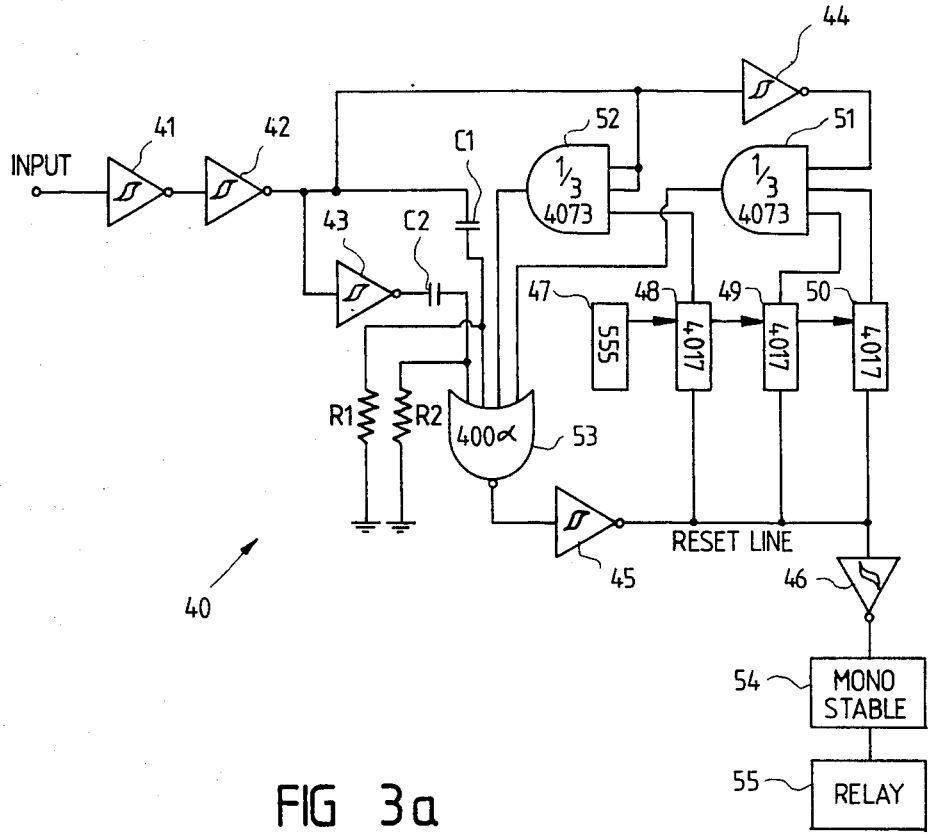
Figure 3B:
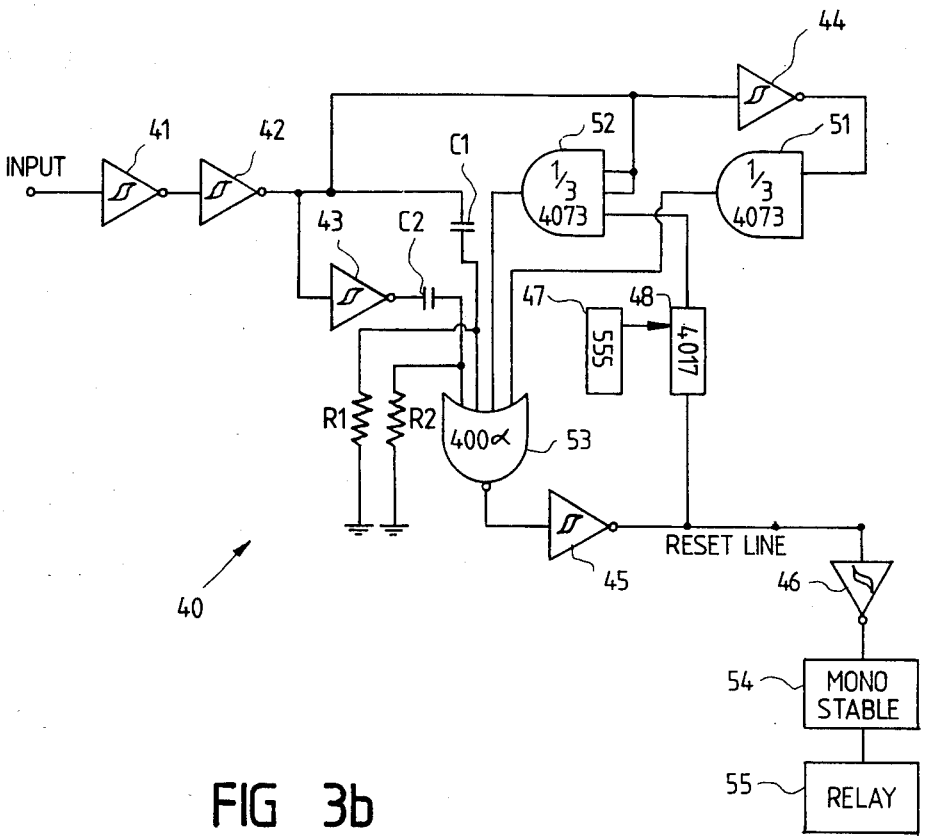

A preferred embodiment of the invention will be described by way of example with reference to the accompanying drawings in which:

FIG. 1 shows a block diagram of part of a flushing system according to an embodiment of the invention;

FIG. 2*a* shows a side view of a flushing system according to an embodiment of the invention;

FIG. 2*b* is a side view of a flushing system which may be modified and converted into a system according to the invention;

FIG. 2*c* is a front view of a flushing system according to the embodiment of the invention shown in FIG. 2*a*;

FIGS. 3*a* and 3*b* show embodiments of circuits for controllers according to the invention;

FIG. 1 shows a sensor 3 provided by a supply. The supply may be derived from the mains or from any other suitable source. The sensor is an ultrasonic, infrared or microwave sensor which detects the presence or proximity of an intending user. Control line 4 from the sensor provides a control signal to cause controller 7 to operate the valve 8. As indicated, the valve 8 remains open for 5 seconds every half minute. Controller 9 is optional and functions independently of controller 7. Controller 9 automatically operates the valve 8 to open it for 5 seconds every hour.

FIGS. 2*a* and 2*c* show a flushing system 20 in accordance with an embodiment of the invention. System 20 has one or more sensors 29 arranged in a ceiling and extending spaced along the urinal wall 27. A mains inlet 21 for water conveys water to solenoid valve 22 via a stop valve 22*a*. The outlet from valve 22 feeds into a vented vessel 24 having a vent cap 24*a*. Manual control 28 may be depressed to actuate solenoid valve 22. An outlet 23 extends from the vessel 24 to a spreader 31 having a plurality of spaced apertures 26 along its length. Spreader 31 is located within a weir sparge 30 open at the bottom. Apertures 26 face upwardly to direct water onto the inside of the top wall of the sparge 30. An overflow pipe 32 extends out from vessel 24 and communicates with the spreader 31. Most of the components of the system are concealed and therefore are not prone to attack by vandals. Overflow pipe 32 communicates with spreader 31. The upper end of the pipe 32 is open to the inside of vessel 24 and thus the level of fluid within vessel 24 cannot exceed the height of open end 33 of pipe 32. Valve 22 has its outlet coupled to vessel 24 by conduit 34. The open end 35 of conduit 34 is inside the vessel 24. Spreader 31 has a cap 36 at both its ends (only one is shown). Leads 37 couple the manual control to valve 22.

FIG. 2*b* shows an existing flushing system converted to function according to the invention. A mains inlet 21 directs water to a solenoid valve 22. The vessel 24 is the existing header tank but modified by removing the normal ball or float valve and one flushing device. When solenoid valve 22 operates water discharges into the tank and flushes out through the spreader as previously mentioned.

FIG. 2*c* shows a front view of an embodiment of a flushing system according to the invention. This embodiment is suitable for large installations. The system is divided into sections 30*a*, 30*b* of about 1.2 m and each section may have its spreader supplied from a separate vessel and by operation of a separate solenoid valve. Each section has a separate sensor. In FIG. 2*c* sections 30*a*, 30*b* are both supplied from the same vessel 24.

The or each sensor is linked in a suitable manner (not shown) to a solenoid valve to control the valve in response to the proximity of a user of the urinal.

FIG. 3*a* shows a controller which provides for control of valve 8 to turn it on for 5 seconds and off for 20–25 seconds or on for 5 seconds and off for 59 minutes 55 seconds. The controller 40 includes schmitt triggers 41, 42, 43, 44, 45 and 46. Controller 40 receives as its input the output from the sensor. The controller 40 has a free running or astable multivibrator 47 for providing input pulses to the first one of series connected counters 48, 49, 50. AND gates 51, 52 decode the outputs from counters 48, 49 and 50 to provide a reset pulse supplied to the counters via NOR gate 53. Gate 53 receives as its input signals from AND gates 51 and 52 and from timing elements $C_1$, $C_2$, $R_1$, $R_2$. In addition to providing a reset pulse for the counters gate 53 also provides an output to trigger monostable 54 via schmitt trigger 46. Monostable controls the function of relay 55. The relay is used to control valve 30.

FIG. 3*b* is similar to the circuit of FIG. 3*a* except that it provides a short term timer to ensure that the valve controlled by relay 55 is on for 5 seconds and off for 20–25 seconds. This circuit does not have counters 49 and 50 of circuit 3*a*. AND gate 51 is wired to function by connecting together all inputs. Alternatively all of the inputs apart from that derived from trigger 44 may be connected to the supply voltage.

The system of the invention not only results in water being conserved but ensures that adequate flushing occurs. Flushing does not need to be initiated by the user but occurs automatically upon the presence of a user being detected. Should the presence of a user not be detected for an hour since the last automatic flush the system may optionally initiate a flushing action to ensure that the urinal remains clean. The system initiates flushing for predetermined intervals and thus metered quantities of water are employed and water is conserved.

The claims defining the invention are as follows:

1. An automatic flushing system for controlling the flushing operation of a urinal, the system comprising:
   - a remotely controllable valve arranged in a flow path of an inlet to the urinal;
   - sensor means for detecting the presence of a person intending to use said urinal;
   - first valve controlling means operatively coupled to said valve and to said sensor means for operating said valve in response to signals from said sensor means, said controlling means including timer means for providing an output for a first predetermined time period in response to a detection signal from said sensor means indicating the arrival of a user at said urinal, said timer means being operatively connected to said valve for opening same to flush said urinal during said first predetermined time period, said controlling means further including counter means operatively connected to said sensor means for counting out a second predetermined time period in response to said detection signal, said counter means being operatively connected to said timer means for inhibiting further operation thereof in response to continued movement by the user at said urinal and for enabling an actuation of said timer means upon departure of the user to provide a further output to said valve for opening same to flush said urinal for another period equal in duration to said first predetermined time period.

2. The system of claim 1 wherein said first predetermined time period has a duration of approximately five seconds.

3. The system of claim 2 wherein said timer means cannot be reactivated to open said valve within said second predetermined time period after the receipt of said detection signal from said sensor means.

4. The system of claim 3 wherein said second time period has a duration of approximately twenty-five seconds.

5. The system of claim 1, further comprising second valve controlling means operatively connected to said valve and operating independently of said first valve controlling means for operating said valve after elapse of a period of time to cause a flushing action lasting for a further predetermined time period.

6. The system of claim 5 wherein the elapsed period of time is approximately an hour and said further predetermined time period has a duration of approximately five seconds.

7. The system of claim 1 wherein said first valve controlling means includes a clock pulse generator, said counter means receiving an output from said generator, said first valve controlling means further including decoding means responsive to an output from said counter means for providing a reset signal for triggering said timer means.

8. The system of claim 7, further comprising second valve controlling means operatively connected to said valve and operating independently of said first valve controlling means for operating said valve after elapse of a period of time to cause a flushing action lasting for a further predetermined time period.

9. The system of claim 8 wherein said second valve controlling means includes additional counter means operatively connected to the counter means of said first valve controlling means for counting out the elapsed period of time in response to pulses from the counter means of said first valve controlling means, said second valve controlling means further including additional decoding means operatively tied to said additional counter means for resetting same and the counter means of said first valve controlling means and for triggering said timer means, in response to an output signal of said additional counter means.

10. The system of claim 1 wherein said sensor means comprises an ultrasonic or microwave sensor.

11. An automatic flushing system for controlling the flushing operation of a urinal, the system comprising:

a remotely controllable valve arranged in a flow path of an inlet to the urinal;

sensor means for detecting the presence of a person intending to use said urinal;

valve controlling means operatively coupled to said valve and to said sensor means for operating said valve in response to signals from said sensor means, said controlling means including timer means for providing an output for a first predetermined time period in response to a detection signal from said sensor means indicating the arrival of a user at said urinal, said timer means being operatively connected to said valve for opening same to flush said urinal during said first predetermined time period, said controlling means further including counter means operatively connected to said sensor means for counting out a second predetermined time period in response to said detection signal, said counter means being operatively connected to said timer means for inhibiting further operation thereof during said second predetermined time period, for inhibiting operation of said timer means in response to continued movement by the user at said urinal, and for enabling an actuation of said timer means upon departure of the user to provide a further output to said valve for opening same to flush said urinal for another period equal in duration to said first predetermined time period.

* * * * *

UNITED STATES PATENT AND TRADEMARK OFFICE

CERTIFICATE OF CORRECTION

PATENT NO. : 4,624,017

DATED : November 25, 1986

INVENTOR(S) : John Durham Foletta

It is certified that error appears in the above-identified patent and that said Letters Patent is hereby corrected as shown below:

Column 1, line 24, insert --so-- after "used".

Column 3, between lines 65 and 66, insert the following paragraphs:

--As illustrated in Figure 3b, schmitt trigger 41 is connected at an output to schmitt trigger or inverter 42 which in turn has an output connected to a first input of NOR gate 53 via capacitor C1 and to another input of NOR gate 53 via schmitt trigger 43 and capacitor C2. In addition, the output of inverter 42 is coupled to two inputs of AND gate 52. Gate 52 has an output coupled to an input of NOR gate 53. The output of NOR gate 52 is inverted by schmitt trigger 45, again inverted by schmitt trigger 46 and fed to monostable element 54 to trigger that element. The output of schmitt trigger 45 also resets counter 48, a train of stepping pulses being fed to this counter from a stable multivibrator 47. Counter 48 has an output connected to an input of AND gate 52. Monostable element 54 energizes relay 55 to control the flush valve.

--Capacitors C1 and C2 ensure that a pulse is applied to monostable element 54 upon any change of state of the input of schmitt trigger 41. This trigger inverts its input signal which is again inverted by schmitt trigger 42.

UNITED STATES PATENT AND TRADEMARK OFFICE

CERTIFICATE OF CORRECTION

PATENT NO. : 4,624,017

DATED : November 25, 1986

INVENTOR(S) : John Durham Foletta

It is certified that error appears in the above-identified patent and that said Letters Patent is hereby corrected as shown below:

--Upon a change in the state of the input signal to schmitt trigger or inverter 41, monostable element 54 is reset and times the five second flushing period during which relay 55 opens the flushing valve. After the five second period, counter 48 and gate 52 ensure that further activity by relay 55 is inhibited. Upon a change in the input to inverter 41, counter 48 is reset and measures out a time period of approximately 25 seconds. At the end of that period, counter 48 provides an output to gate 52 which enables monostable element 54 to time another five second flushing period.

--The circuit of Figure 3b ensures that a flush occurs upon the arrival of a person at the urinal. The arrival of a person also resets counter 48. Should further movement occur (either further movement by the first user or by another user), counter 48 is reset and inhibits the actuation of relay 55. Once movement ceases, counter 48 counts out the twenty five second inhibitory period and the additional five second flush occurs. Thus, a flush occurs upon the arrival of a user and also after the user leaves.--

Signed and Sealed this

Second Day of February, 1988

*Attest:*

DONALD J. QUIGG

*Attesting Officer*

*Commissioner of Patents and Trademarks*